United States Patent [19]

Jageler

[11] Patent Number: 4,667,753

[45] Date of Patent: May 26, 1987

[54] CORE RETAINER FOR SIDEWALL CORE TOOLS

[75] Inventor: Alfred H. Jageler, Tulsa, Okla.

[73] Assignee: Standard Oil Company, Chicago, Ill.

[21] Appl. No.: 655,844

[22] Filed: Sep. 27, 1984

Related U.S. Application Data

[63] Continuation-in-part of Ser. No. 452,255, Dec. 22, 1982, abandoned.

[51] Int. Cl.[4] ..... E21B 25/06

[52] U.S. Cl. ..... 175/244; 175/249

[58] Field of Search ..... 175/249, 244, 245, 246, 175/243, 253, 330, 387, 403; 277/235 R; 285/423, 260, 420

[56] References Cited

U.S. PATENT DOCUMENTS 2,251,679 8/1941 Kinnear ..... 175/247
3,807,234 4/1974 Duperon ..... 175/249
4,059,293 11/1977 Sipler ..... 285/236
4,156,469 5/1979 Laskey ..... 175/245 X
4,400,267 8/1983 Brose ..... 285/420 X

FOREIGN PATENT DOCUMENTS 2617551 10/1977 Fed. Rep. of Germany ..... 175/245

*Primary Examiner*—Stephen J. Novosad
*Assistant Examiner*—David J. Bagnell
*Attorney, Agent, or Firm*—Fred E. Hook; Timothy H. Briggs

[57] ABSTRACT

A hollow truncated cone made from material with elastic properties which expands around a core being cut from the sidewall of a borehole drilled in the earth with a core cutting means rigidly connected to a core barrel. The hollow truncated core is held in position inside the core barrel such that it does not rotate with the core cutting means during the cutting of a core.

6 Claims, 8 Drawing Figures

STEEL CORE CATCHER RING

CORE RETAINER FOR SIDEWALL CORE TOOLS

This application is a continuation in part of application Ser. No. 452,255, filed Dec. 22, 1982 now abandoned.

BACKGROUND OF THE INVENTION

This invention relates to sidewall coring tools. In determining the physical properties of subterranean formations, it is of great assistance to have what is commonly called cores. A core is typically a cylindrical piece of rock which has been cut from the underground formation and can vary in size and length. One type of core cutter is a type that can be used to cut the cores from the sidewall of a borehole after the borehole has already been drilled. Such a sidewall coring tool is described in U.S. Pat. No. 4,354,558 entitled, "Apparatus and Method for Drilling into the Sidewall of a Drill Hole," issued Oct. 19, 1982, with Alfred H. Jageler, Robert A. Broding and Lauren G. Kilmer as inventors. In that invention, a core barrel having a core cutting bit on the end thereof is pushed against the formation at the same time that the core barrel is rotated so that a core is cut and enters the core barrel. The present invention relates to system for retaining the core in the core barrel once the core is cut.

BRIEF DESCRIPTION OF THE INVENTION

This invention relates to an apparatus for use in cutting a sidewall core in a borehole and includes a hollow core barrel with a hollow core cutting bit attached to the end thereof. Means are provided to rotate the core cutting bit and core barrel and to drive the core cutting bit against the interior face of the borehole. In a preferred embodiment of my invention, a groove is cut circumferentially in the inside of the core barrel at the core cutting bit end and a core retaining sleeve is inserted therein. The core retaining sleeve is constructed of a material having elastic properties and is of a size and shape such that it will be expanded to grip and retain a core being cut and entering the core barrel and retaining sleeve, and is mounted such that the core retainer sleeve does not rotate as the core barrel and core cutting bit rotates for cutting the core. This is accomplished by designing the core retaining sleeve with a flange that has external dimensions smaller than the internal dimensions of the groove in the core barrel but with exterior dimensions which are large enough that the flange is not forced out of the groove during the cutting of a core, and such that the exterior dimensions of the core retaining sleeve with a core extending therein are smaller than the internal dimensions of the core barrel. The flange is reinforced with a metal ring as an aid in maintaining the flange in the groove during the cutting of a core.

A better understanding of the invention may be had from the following description taken in conjunction with the drawing.

BRIEF DESCRIPTIONS OF THE DRAWINGS

DETAILED DESCRIPTION

Figure 1:
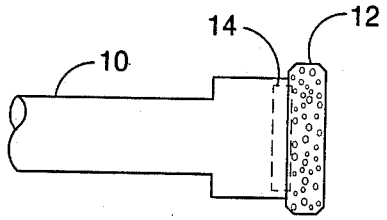
FIG. 1 is the schematic side view of a core barrel and a core cutting bit.
Figure 2:
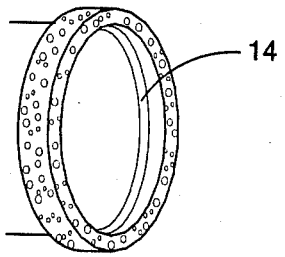
FIG. 2 is an isometric view of the core bit having an internal ring groove.
Figure 3:
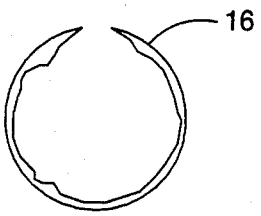
FIG. 3 shows a steel core retaining ring.

FIG. 1 illustrates a core barrel 10 with core cutting bit 12 which is used in the prior art core cutting methods. It has an internal groove 14 which is shown more clearly in FIG. 2, which is an isometric view of the core cutting bit. A steel core catcher ring 16, illustrated in FIG. 3, is insertable into groove 14 of the core cutting bit, but not in such tight contact so that the core catcher ring will rotate with rotation of the core cutting head. The ring is situated such that as the core is cut by the core cutting bit moving into the rock, the cored section is inserted into the ring. The internal diameter of the ring is slightly smaller than the internal diameter of the core barrel. The ring 16, being split, expands and attaches itself to the core. The barrel revolves around the ring as the coring operation continues, thus, the ring does not rotate but merely slides along the exterior surface of the cut core.

Figure 4:
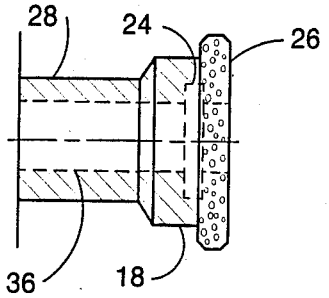
FIG. 4 is a schematic side view of a core barrel and core cutting head useful in the present invention.
Figure 5:
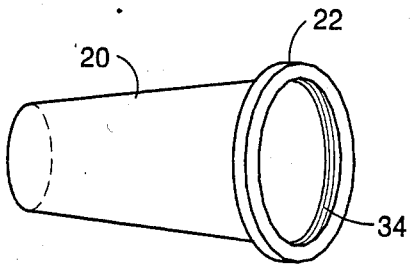
FIG. 5 is an isometric view of the core retaining sleeve in the present invention.
Figure 6:
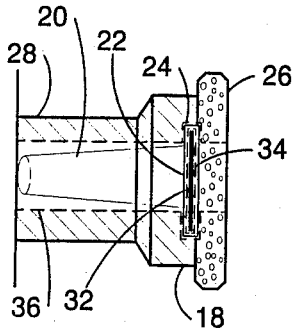
FIG. 6 is a schematic side view of a core retaining sleeve of FIG. 5 in position inside the core barrel and core cutting head of FIG. 4.
Figure 7:
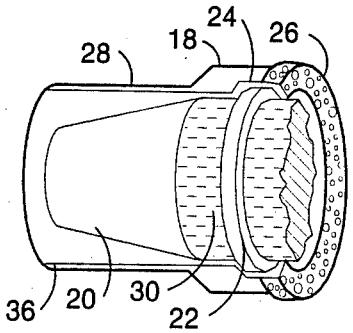
FIG. 7 is an isometric view of the core retaining sleeve of FIG. 5 in position inside the core barrel and core cutting head of FIG. 4, expanded over a partially cut core.
Figure 8:
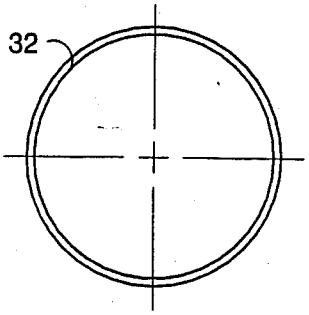
FIG. 8 illustrates a metal retaining ring for use in the core retaining sleeve of FIG. 5.

The core retaining sleeve of this invention is particularly useful in the case of cutting cores from both fractured rock and unconsolidated rock, such as oil sands or chalks, where the cores can crumble during the cutting and then drop out of the end of the core barrel when the core barrel is retracted for core recovery. Attention will now be directed to the present invention. A core retaining sleeve in the form of a truncated cone 20 having a flange 22 at one end with a circumferential groove 34 on the interior rim of the flange is illustrated in FIG. 5. This core retaining sleeve can be made from a rubber or other resilient materials having elastic properties, such as Neoprene. It is a requirement that the material be such that it will not be damaged by the fluids which may be encountered in the drill hole. A core barrel 28 with a core cutting bit 26 attached to a core cutting head 18 is illustrated in FIG. 4. The flange 22 rides in circumferential groove 24 cut inside the core cutting head 18 near the core cutting bit end of the core cutting head, shown in FIG. 4, in such a way that during the cutting of a core when the core retaining sleeve is gripping the stationary core, it is not rotated by the rotation of the core cutting head and core cutting bit. It is felt that rotation of the core retaining sleeve around the core would expose the core to forces which would tend to crumble fractured and/or unconsolidated rock cores inside the core retaining sleeve and thus cause them to drop out of the core retaining sleeve when the core barrel is retracted for core recovery. The core retaining sleeve 20 in place inside the core barrel 28 and core cutting head 18 is shown in FIG. 6. As shown in FIG. 6 and FIG. 7, the inside diameter of the core barrel 36, the core cutting head 18 and the core cutting bit 26, is sufficiently large to allow for expansion of the core retaining sleeve 20 over the core as the core enters into the core barrel 36, such that the core retaining sleeve 20 does not contact the interior wall of the core barrel. As is shown in FIG. 7, the core retaining sleeve 20 expands over the cut core 30 as it enters the core barrel. The rubber flange 22 is reinforced by a metal ring 32, illustrated in FIG. 8, set inside circumferential groove 34 in flange 22 of the core retaining sleeve 20. The purpose of this metal ring is to prevent the flange from deforming under the forces generated as the core is inserted into the core retaining sleeve, and thus, cause the flange to remain in place in circumferential groove 24 inside the core cutting head as the core is inserted into the core retaining sleeve. The internal diameter of the metal ring is such that it does not damage a core extending into the core retaining sleeve.

As the leading edge of the core penetrates the core bit 26, the core retaining sleeve 20 begins to expand over the core end and with continued penetration of the core, the core retaining sleeve expands so that its inside diameter is the same as the outside diameter of the core. This results in the core retaining sleeve forming a tight sleeve around the core. In the case of cores cut from fractured and/or unconsolidated formations, this sleeve aids the core in retaining its shape and preventing crumbling of the core during the cutting. The lack of rotation of the core retaining sleeve is important since a rotation of the core retaining sleeve around the core would expose the core to forces which would tend to crumble it inside the core retaining sleeve.

The core retaining sleeve just described in this invention has been implemented and tested and was made of Neoprene.

While the above invention has been described in detail, various modifications can be made thereto without departing from the spirit or scope of the invention.

What is claimed is:

1. An apparatus for use with a downhole sidewall core cutting tool for retaining a cut core comprising:

a rotatable core barrel connected to the downhole sidewall core cutting tool through a means for rotating the core barrel under conditions for cutting core from the sidewall of a borehole penetrating subterranean formations;

a core cutting head rigidly connected to one end of said barrel and having a circumferential internal groove; and a resilient open-ended sleeve means for retaining a cut core having elastic properties and positioned inside the core barrel with a flange means for maintaining the position of the core within the core barrel, wherein the sleeve means is of a size and shape such that it will be expanded to grip and retain a core being cut and entering the core barrel and such that the exterior dimensions of the sleeve means are smaller than the internal dimensions of the core barrel and wherein the flange means has external dimensions sufficiently smaller than the internal dimensions of the groove in the core cutting head such that the sleeve means does not rotate as the core barrel rotates during the cutting of cores and the flange means has external dimensions sufficiently large that the flange means is not forced out of the groove during the cutting of cores and wherein the flange means is reinforced with a metal ring for maintaining the flange in the groove during cutting of cores.

2. An apparatus for use with a downhole sidewall core cutting tool for retaining a cut core, as recited in claim 1, wherein said resilient sleeve means consists of a hollow truncated cone.

3. An apparatus for use with a downhole sidewall core cutting tool for retaining a cut core, as recited in claim 1, wherein the flange has a circumferential internal groove.

4. An apparatus for use with a downhole sidewall core cutting tool for retaining a cut core as recited in claim 3 wherein the metal ring is removably inserted into the flange circumferential internal groove.

5. An apparatus for use with a downhole sidewall core cutting tool for retaining a cut core comprising:

a rotatable core barrel connected to the downhole sidewall core cutting tool through a means for rotating the core barrel under conditions for cutting core from the sidewall of a borehole penetrating subterranean formations and having a circumferential internal groove at the core cutting head end thereof;

a core cutting head rigidly connected to one end of the core barrel; and a resilient open-ended sleeve means for retaining a cut core having elastic properties and positioned inside the core barrel with a flange means for maintaining the position of the core within the core barrel, wherein the sleeve means is of a size and shape such that it will be expanded to grip and retain a core being cut and entering the core barrel and such that the exterior dimensions of the sleeve means are smaller than the internal dimensions of the core barrel and wherein the flange means has external dimensions sufficiently smaller than the internal dimensions of the groove in the core barrel such that the sleeve means does not rotate as the core barrel rotates during the cutting of cores and the flange means has external dimensions sufficiently large that the flange means is not forced out of the groove during the cutting of cores and wherein the flange means is reinforced with a metal ring which is removably insertable in a circumferential internal groove in the flange means for maintaining the flange means in the groove during the cutting of cores.

6. An apparatus for use with a downhole sidewall core cutting tool for retaining a cut core, as recited in claim 5, wherein said resilient sleeve means consists of a hollow truncated cone.

* * * * *